US011779933B2

(12) United States Patent
Nemedi

(10) Patent No.: US 11,779,933 B2
(45) Date of Patent: Oct. 10, 2023

(54) CHIP SEPARATOR FOR SEPARATING CLUSTERS OF CHIPS

(71) Applicant: INTER-SOURCE RECOVERY SYSTEMS, Kalamazoo, MI (US)

(72) Inventor: William D. Nemedi, Paw Paw, MI (US)

( * ) Notice: Subject to any disclaimer, the term of this patent is extended or adjusted under 35 U.S.C. 154(b) by 164 days.

(21) Appl. No.: 17/501,440

(22) Filed: Oct. 14, 2021

(65) Prior Publication Data

US 2022/0168747 A1 Jun. 2, 2022

Related U.S. Application Data

(60) Provisional application No. 63/119,283, filed on Nov. 30, 2020.

(51) Int. Cl.

| | |
|---|---|
| ***B02C 13/16*** | (2006.01) |
| ***B02C 13/286*** | (2006.01) |
| ***B02C 19/00*** | (2006.01) |
| ***B02C 13/28*** | (2006.01) |
| ***B02C 13/18*** | (2006.01) |

(52) U.S. Cl.

CPC ..... *B02C 13/1814* (2013.01); *B02C 13/16* (2013.01); *B02C 13/286* (2013.01); *B02C 19/0062* (2013.01); *B02C 2013/2808* (2013.01); *B02C 2013/2816* (2013.01); *B02C 2013/28618* (2013.01)

(58) Field of Classification Search

CPC . B02C 13/16; B02C 13/30; B02C 2013/2808; B02C 2013/2825; B02C 2013/286; B02C 2013/28609; B02C 2013/28618; B02C 7/14; B02C 13/14–185; B02C 2013/1857–1892; B02C 18/08–12; B02C 18/24; B02C 7/186

See application file for complete search history.

(56) References Cited

U.S. PATENT DOCUMENTS 1,212,418 A * 1/1917 Sturtevant ..... B02C 13/18 241/154
1,212,419 A * 1/1917 Sturtevant ..... B02C 13/16 241/154

(Continued)

FOREIGN PATENT DOCUMENTS

CN 110404630 A * 11/2019

OTHER PUBLICATIONS

Liu, Translation of CN-110404630-A (Year: 2019).*

*Primary Examiner* — Bobby Yeonjin Kim
(74) *Attorney, Agent, or Firm* — Marshall, Gerstein & Borun LLP

(57) ABSTRACT

A chip separator configured to disentangle clusters of chips in a collection tank is disclosed. The chip separator includes a horizontal plate having a first surface and a second surface opposite the first surface, a motor assembly coupled to the first surface of the horizontal plate; and a pulverizer operably coupled to the motor assembly and disposed away from the second surface of the horizontal plate by a distance. The pulverizer includes a base plate and a plurality of pulverizer attachments operably coupled to the base plate. The motor assembly is configured to rotate the pulverizer such that the plurality of pulverizer attachments of the pulverizer disentangles clusters of chips disposed in the collection tank.

8 Claims, 9 Drawing Sheets

(56) References Cited

U.S. PATENT DOCUMENTS

| | | | | |
|---|---|---|---|---|
| 5,950,945 | A * | 9/1999 | Schaller | B02C 18/146 241/300 |
| 2003/0178518 | A1* | 9/2003 | Nemedi | B02C 18/146 241/243 |
| 2021/0053069 | A1* | 2/2021 | Riggenmann | B02C 13/282 |

* cited by examiner

CHIP SEPARATOR FOR SEPARATING CLUSTERS OF CHIPS

CROSS-REFERENCE TO RELATED APPLICATIONS

Priority is claimed to U.S. Provisional Patent Application No. 63/119,283, filed Nov. 30, 2021, the entire contents of which are hereby incorporated herein by reference.

FIELD OF THE DISCLOSURE

The present disclosure generally relates to chip collectors and, more particularly, to a chip separator used to disentangle clusters of chips generated during machining operations.

BACKGROUND

In the course of machining operations, scrap materials are generated. These scrap materials may be referred to generally as wet chips, or wet chip material, which material includes a solid component and a fluid (lubricant) component. This scrap material may be in the form of relatively small wet chips, also referred to as granular wet chips, stringy pieces of wet chips, and bales of wet chip material.

Conventionally, chip materials are conveyed from one or more machine stations to a tank, or other container, where the chip material pumped, or otherwise evacuated, to other locations for further processing. Many different conveyors or methods of conveyance are known, including pneumatic transport of the wet chip material and chip material suspended in fluid flowing through a fluid pathway from the machine stations to the tank, or other container.

SUMMARY

In a first aspect, a chip separator configured to disentangle clusters of chips in a collection tank is disclosed. The chip separator includes a horizontal plate having a first surface and a second surface opposite the first surface, a motor assembly coupled to the first surface of the horizontal plate, and a pulverizer operably coupled to the motor assembly and disposed away from the second surface of the horizontal plate by a distance. The pulverizer includes a base plate and a plurality of pulverizer attachments operably coupled to the base plate. In the first aspect, the motor assembly is configured to rotate the pulverizer such that the plurality of pulverizer attachments of the pulverizer separate clusters of chips disposed in a collection tank.

In a second aspect, a system for disentangling clusters of chips in a mixture of chips and fluid is disclosed. The system includes a collection tank having a body, a cover coupled to the body, and an intake disposed on an extending through the body. The intake configured to be fluid coupled to a trough such that the mixture of chips and fluid enters the body through the intake. The system also includes a chip separator configured to be disposed at least partially within the body of the collection tank such that the chip separator is disposed proximate the intake. The chip separator includes a horizontal plate having a first surface and a second surface opposite the first surface, a motor assembly operably coupled to the first surface of the horizontal plate, and a pulverizer operably coupled to the motor assembly and disposed away from the second surface of the horizontal plate by a distance. The pulverizer includes a base plate and a plurality of pulverizer attachments operably coupled to the base plate. In the second aspect, the motor assembly is configured to rotate the pulverizer such that the plurality of pulverizer attachments of the pulverizer separate the clusters of chips disposed in the collection tank.

In accordance with the foregoing first and/or second aspects, the chip separators may further include any one or more of the following preferred forms.

In one preferred form, a plurality of securement mechanisms is coupled to the horizontal plate and the plurality of securement mechanisms is configured to secure the horizontal plate to the cover of the collection tank or a surface above the collection tank.

In another preferred form, the motor assembly includes a drive, a drive shaft that operably couples the drive and the pulverizer, and a drive plate that releasably receives the drive.

In another preferred form, a plurality of rods operably couples the horizontal plate and the motor assembly to the collection tank or a surface above the collection tank such that rotation of each rod in the plurality of rods moves the motor assembly relative to the collection tank or the surface above the collection tank.

In another preferred form, an elongated cylinder extends from the drive mechanism toward the pulverizer for a distance.

In another preferred form, an elongated cylinder is coupled to the drive plate of the motor assembly.

In another preferred form, the plurality of pulverizer attachments includes a plurality of chains releasably coupled to the base plate.

In another preferred form, the plurality of pulverizer attachments includes a plurality of blades releasably coupled to the base plate.

In another preferred form, at least a portion of at least one blade of the plurality of blades is serrated.

In another preferred form, a plurality of rods operably coupled the horizontal plate and the motor assembly. When each rod of the plurality of rods rotates in a first direction, the motor assembly moves away from the collection tank or a surface above the collection tank. When each rod of the plurality of rods rotates in a direction opposite the first direction, the motor assembly moves toward the collection tank or a surface above the collection tank.

BRIEF DESCRIPTION OF THE DRAWINGS

It is believed that the disclosure will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except what may be explicitly delineated in the corresponding written description. None of the drawings are necessarily to scale.

DETAILED DESCRIPTION

The present disclosure is generally directed to a chip separator used to untangle, or break up, clusters of stringy, nesty, matty type chips disposed in a fluid (e.g., a lubricant) that are a byproduct of a machining operation. The chips produced during the machining operation are flushed from the machining operation using a fluid (e.g., a lubricant) and the mixture of fluid and chips is transported to a tank via a fluid pathway. The chips are typically suspended in a substantial amount of the fluid which allows the chips to freely flow through the fluid pathway from the machining location to the tank. It is possible that, during transportation and/or once the mixture is in the tank, the chips in the mixture collect into clusters of varying sizes. Detrimentally, the clusters of chips in the mixture may stop, or otherwise slow down, fluid flow through the fluid pathway. Similarly, once the chips or clusters of chips are within the tank, the chips or clusters of chips may fall out of suspension in the fluid and float to the top of the fluid. Problematically, the floating chips may clog or prevent pumps from evacuating the mixture of fluid and chips to other locations for further processing.

The disclosed chip separator disentangles the clusters of chips in the tank using a pulverizer, thereby allowing the chips to remain suspended in the fluid without clumping. In particular, the pulverizer of the chip separator is disposed in the tank and rotates such that when clusters of chips come into contact with the pulverizer, the cluster of chips is broken up. Once the clusters of chips are broken up by the pulverizer of the chip separator, the chips are suspended in the fluid which easily passes through the pumps transporting the mixture of fluid and chips to a different location for further processing.

Figure 1:
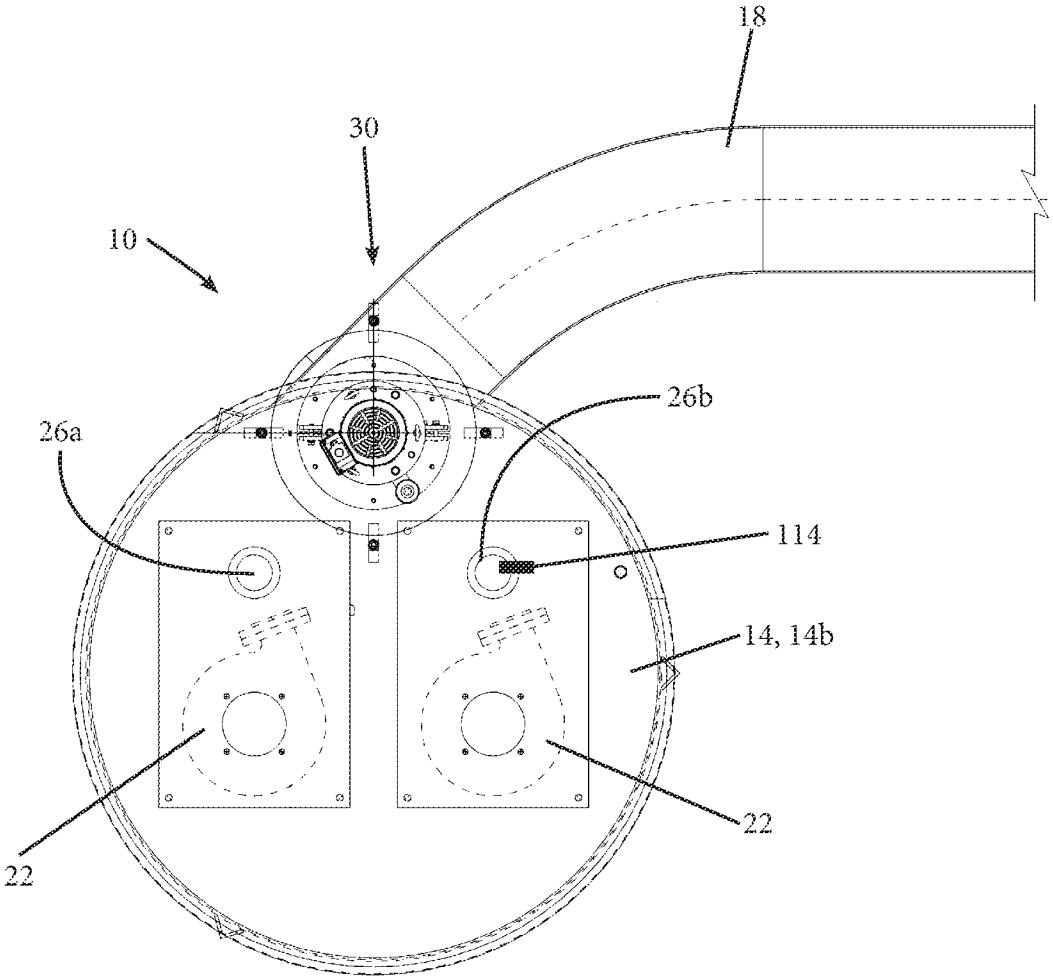
FIG. 1 is a top-down view of an example pneumatic chip collector system, constructed in accordance with the present disclosure.
Figure 2:
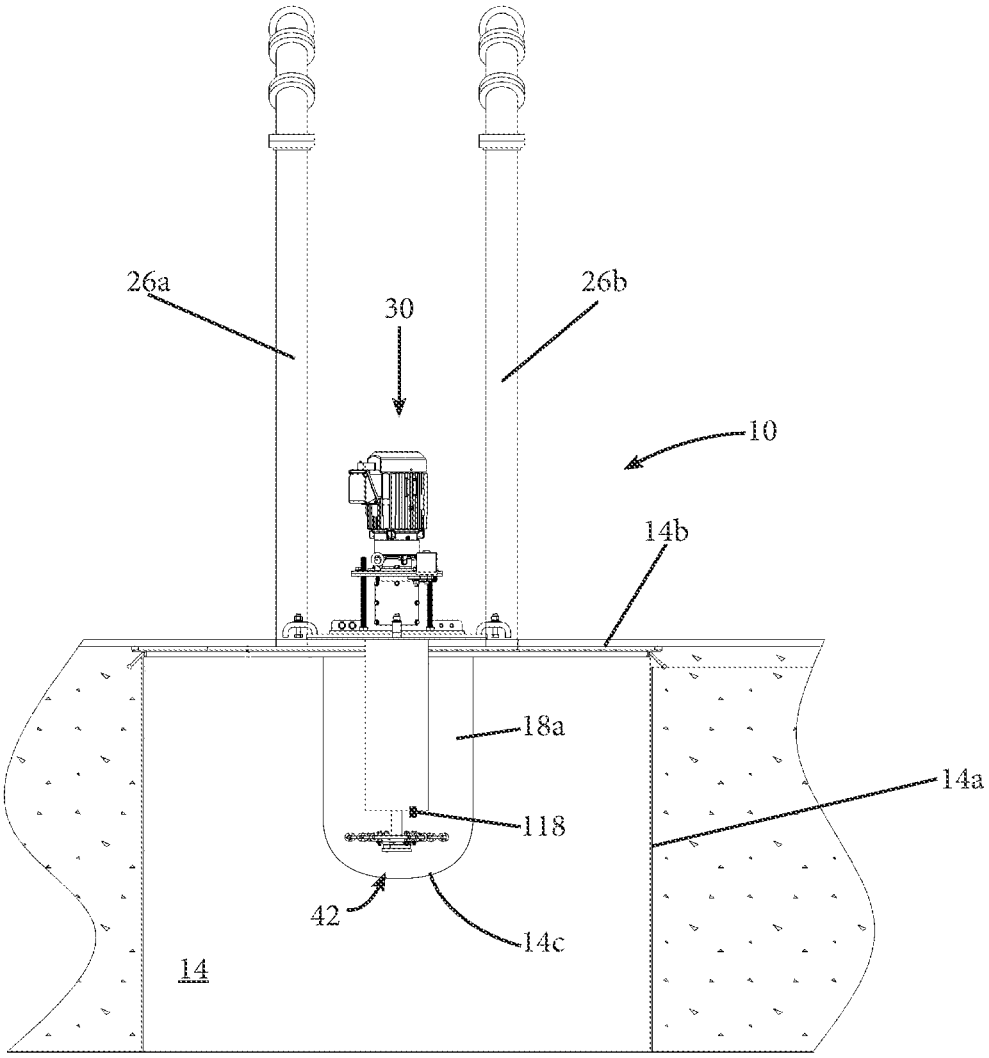
FIG. 2 is a cross-sectional view of the pneumatic chip collector system of FIG. 1, constructed in accordance with the present disclosure.

Referring now to FIGS. 1 and 2, which illustrate an example chip collection system 10. The system 10 includes a collection tank 14, a trough 18 fluidly coupled to the collection tank 14, and a chip separator 30 partially disposed within the collection tank 14. The collection tank 14 is disposed, for example, underground outside of a manufacturing facility and includes a body 14*a*, a cover 14*b* coupled to the body 14*a*, and an intake 14*c* disposed on and extending through the body 14*a*. The trough 18 extends from a machining location (not shown) to the collection tank 14. In some examples, the trough 18 is fluidly coupled to the collection tank 14 at a location on the collection tank 14 that is proximate to the chip separator 30. So configured, the chip separator 30 may interact with chips, and clusters of chips, right as they enter the collection tank 14. Advantageously, this may allow the chip separator 30 to disentangle clusters of chips as soon as the clusters of chips enter the collection tank 14 rather than waiting for the flow of fluid within the collection tank 14 to bring the clusters of chips into contact with the chip separator 30.

A plurality of pumps 22 that evacuate fluid and chips from the collection tank 14 are disposed within the collection tank 14. The plurality of pumps 22 are fluidly coupled to pipes 26*a*, 26*b*, which lead the mixture of fluid and chips to other locations for further processing (e.g., separation of the chips from the fluid). Pumps 22 can be any pump capable of handling the mixture of fluid and chips, including various positive displacement pumps and centrifugal pumps.

As mentioned above, the chip separator 30 is partially disposed within the collection tank 14. For example, as illustrated in FIG. 2, the chip separator 30 can be disposed within the collection tank 14 such that a pulverizer 42 of the chip separator 30 is in line with an outlet 18*a* of the trough 18 (i.e., the intake 14*c* of the collection tank 14). So configured, the clusters of chips may come into contact with the pulverizer 42, which disentangles clusters of chips as soon as the mixture of fluid and chips enters the collection tank 14.

Figure 3:
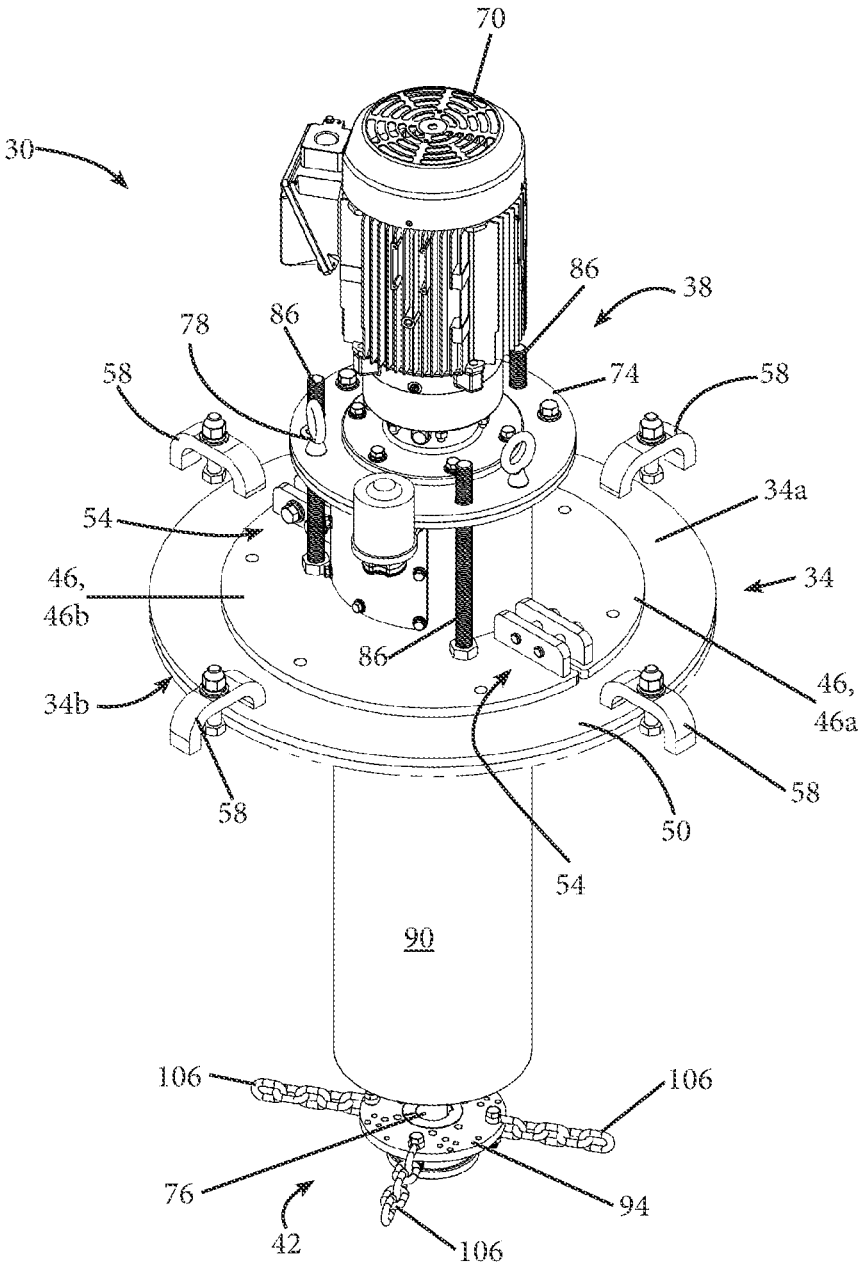
FIG. 3 is a perspective view of an example pneumatic chip separator used in the pneumatic chip collector system of FIG. 1, constructed in accordance with the present disclosure.
Figure 4:
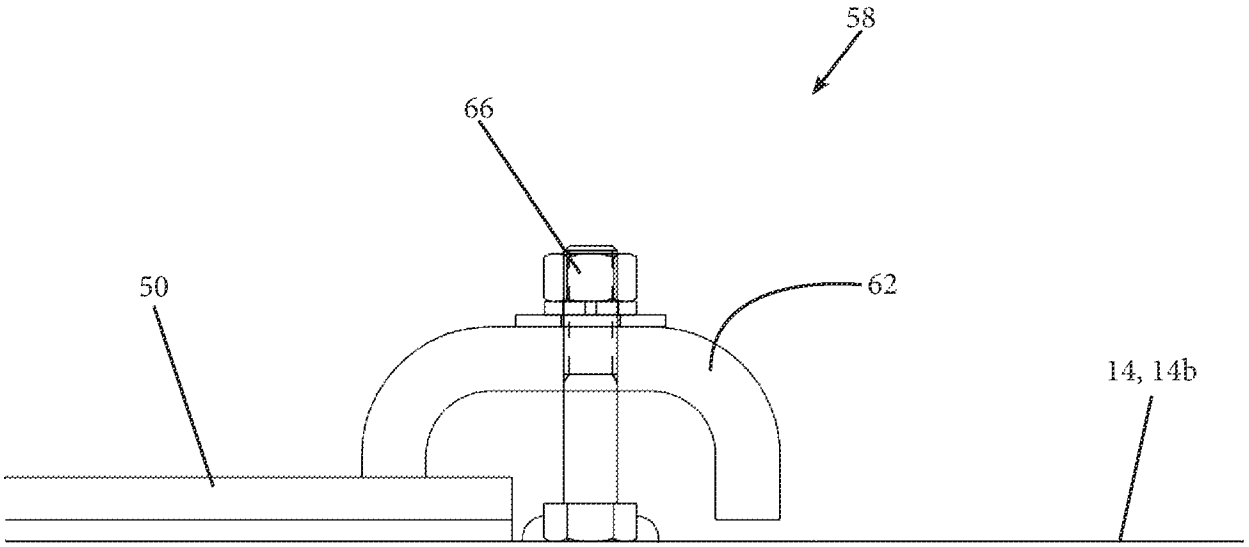
FIG. 4 is a detailed side view of an example securement mechanism of the pneumatic chip collector system of FIG. 1, constructed in accordance with the present disclosure.
Figure 5:
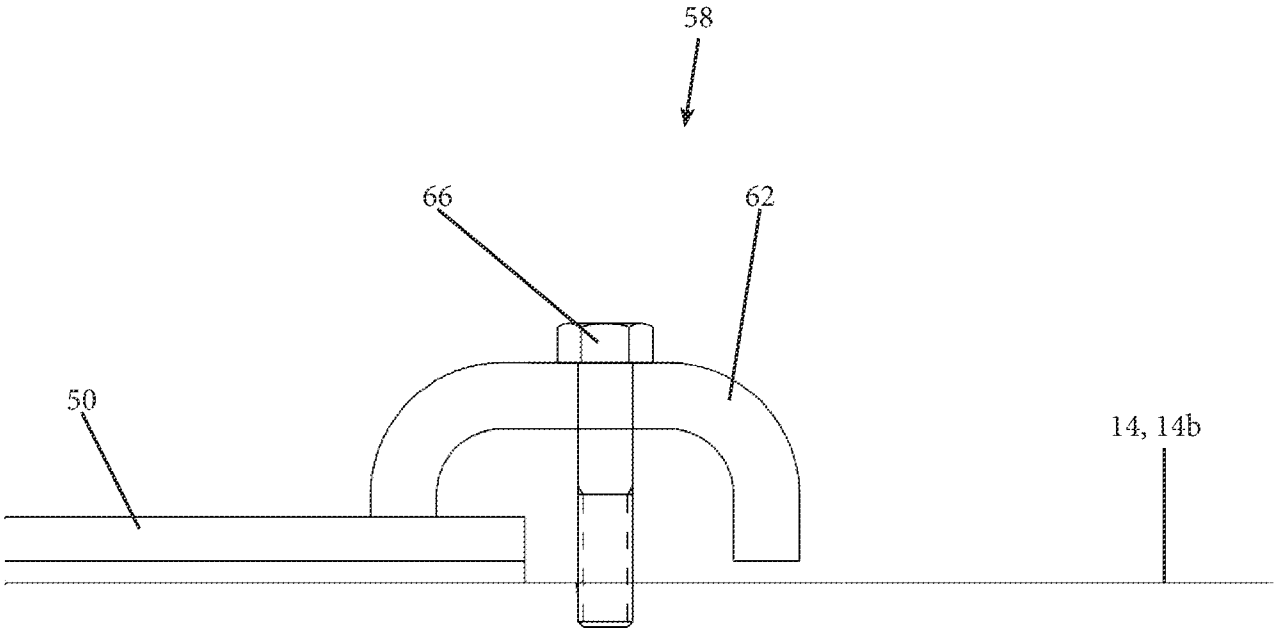
FIG. 5 is a detailed side view of another example securement mechanism of the pneumatic chip collector system of FIG. 1, constructed in accordance with the present disclosure.

Turning now to FIG. 3, the chip separator 30 includes a horizontal plate 34 having a first surface 34*a* and a second surface 34*b* opposite the first surface 34*a*, a motor assembly 38 coupled to the first surface 34*a* of the horizontal plate 34, and the pulverizer 42 operably coupled to the motor assembly 38. The horizontal plate 34 includes an inner plate 46 and an outer plate 50. The inner plate 46 is disposed on top of the outer plate 50 and includes a first half 46*a*, a second half 46*b*, and a plurality of clamps 54 that releasably couple the first and second halves 46*a*, 46*b*. Unlike the inner plate 46, the outer plate 50 is a uniform piece and includes a plurality of securement mechanisms 58 that secure the horizontal plate 34 to the collection tank 14. As seen in FIG. 4, each securement mechanism in the plurality of securement mechanisms 58 includes a hook 62 fixedly attached to the outer plate 50 and a bolt 66 that is coupled to the hook 62 and the cover 14*b* of the containment tank 14. For example, as illustrated in FIG. 4, the bolt 66 can be welded to the cover 14*b* of the containment tank 14. In other examples, such as that illustrated in FIG. 5, the bolt 66 can be fixedly disposed in a blind bore 68 formed in the cover 14*b* of the containment tank 14. However, in various embodiments, the securement mechanisms may be any latching or securing mechanism capable of securing the outer plate 50.

The horizontal plate 34 may take any shape depending on the environment in which the chip separator 30 is used. For example, the horizontal plate 34 can take a circular shape as illustrated in FIGS. 1 and 3. In other examples, the horizontal plate 34 can take a substantially oval shape, obround shape, or any other desirable, polygonal shape including square, triangle, hexagon, etc. The horizontal plate 34 may be made of any material that is suitable for use in the environment in which the chip separator 30 is used. For example, the horizontal plate 34 can be made of a plastic or other light weight polymer. In other examples, the horizontal plate 34 can be made of a metal or other heavy-duty material. The horizontal plate 34 can be formed using any known manufacturing techniques. For example, the horizontal plate 34 can be formed through casting, extrusion, or simple sheet material forming and assembly. In other examples, the horizontal plate 34 can be formed using an additive manufacturing technique that involves adding layer upon successive layer of material, such as, three-dimensional printing.

Referring back to FIG. 3, the motor assembly 38 includes a drive 70, a drive plate 74 that releasably receives the drive 70, and a drive shaft 76 that operably couples the drive 70 to the pulverizer 42. The drive 70 provides the rotational force necessary to rotate the drive shaft 76 and, therefore, the pulverizer 42 such that the pulverizer 42 disentangles clusters of chips in the collection tank 14. The drive 70 may be any drive of adequate power that is capable of creating rotational motion depending on the specific application of the chip separator 30. For example, the drive 70 can be a rotary device such as an electric motor, a pneumatic drive, a hydraulic drive, etc. Specifically, in some examples, the drive 70 can be a direct current ("DC") electric motor coupled to a variable frequency drive mounted on the drive plate 74. In some embodiments, the drive 70 can be a motor having approximately 1-2 horsepower, but may, more preferably be approximately 5 horsepower. Further, the drive 70 may cause the pulverizer 42 to rotate at least 250 revolutions per minute, as many as 1500 revolutions per minute, but may, more preferably rotate at approximately 500-600 revolutions per minute.

The drive 70 is operated by a control module (not shown) that includes a programmable logic controller, which manages the drive 70 during operation of the chip separator 30. In particular, the control module may be disposed anywhere in a manufacturing facility that allows the control module to be used safely. The control module includes a user interface to control the operation of the drive 70 and the chip separator 30. For example, the control module can be disposed on the horizontal plate 34 and includes at least one button and a user interface (or, alternatively, a touch screen display). In such an example, the at least one button (or, alternatively, the touch screen display) can be used to turn the chip separator 30 on and off, change the direction of rotation of the pulverizer 42, as well as turn the plurality of pumps 22 on and off. The user interface (or, alternatively, the touch screen display) can display various operational parameters of the chip separator 30 such as, for example, rotational speed of the pulverizer 42, fluid flow rate of the plurality of pumps 22, an alert signaling the pulverizer 42 is jammed, an alert signaling an issue with the drive 70, the pulverizer 42, etc. In other examples, the control module can be disposed on a workbench or other stationary surface within the manufacturing facility. In such an example, the control module can be communicatively coupled to the chip separator 30, and thus the drive 70, via a hardwired or wireless (e.g., WiFi, Bluetooth, Near Field Communication, or other wireless communication protocol) connection.

Once turned on, the pulverizer 42 may not be in continuous operation. In particular, the drive 70 may cause the drive shaft 76, and thus the pulverizer 42, to rotate immediately upon the chip separator 30 being turned on. However, in other examples, the drive 70 can begin in a neutral position such that the pulverizer 42 does not begin rotating once the chip separator 30 is turned on. The drive 70 can begin rotating the pulverizer 42, for example, after a predetermined amount of time once the chip separator 30 is turned on, manually through the control module, or automatically via a proximity sensor. Additionally, in other examples, the control module can cause the drive 70 to rotate the pulverizer 42 clockwise, counterclockwise, or alternating between clockwise and counterclockwise.

Figure 9:
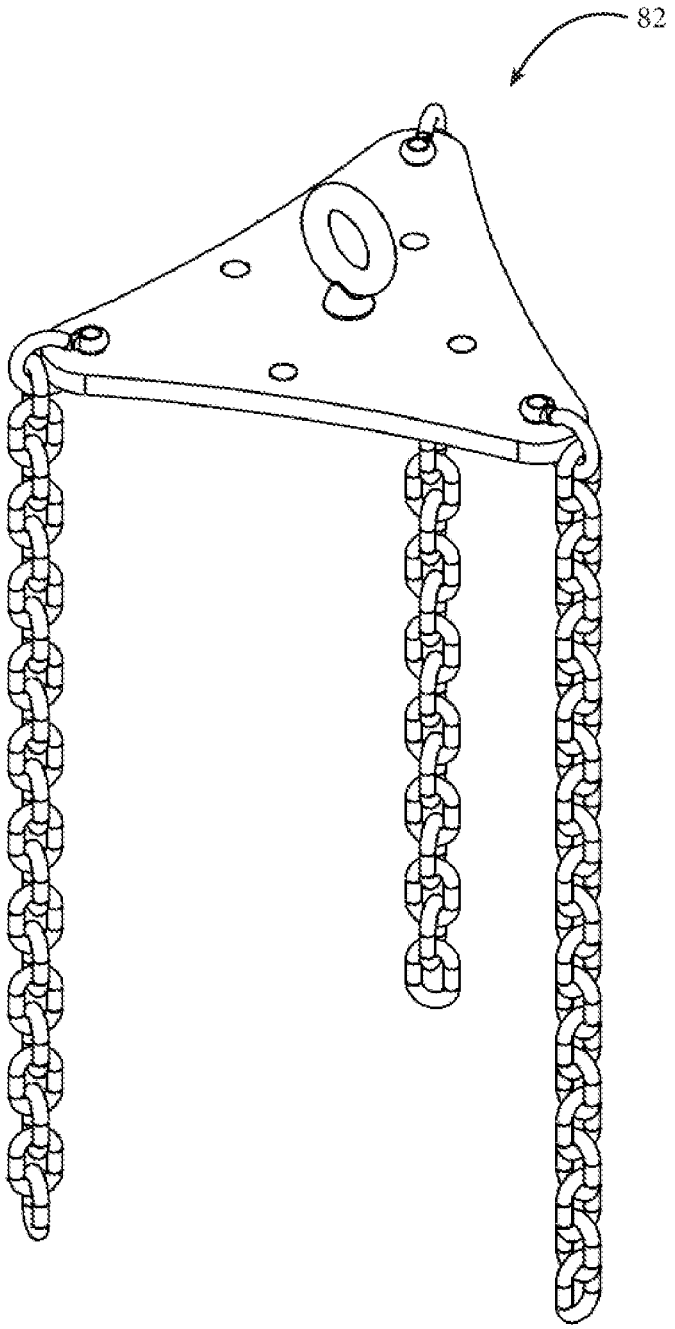
FIG. 9 is a perspective view of an example lift plate assembly used to lift the pneumatic chip separator of FIG. 3.

The drive plate 74 is substantially circular in shape and releasably receives the drive 70. The drive plate 74 also includes a plurality of eyelets 78 that may be coupled to a lift assembly 82 such as, for example, the lift assembly 82 illustrated in FIG. 9, to remove the chip separator 30 from the collection tank 14.

As seen in FIG. 3, a plurality of rods 86 operably couples the horizontal plate 34 and the drive plate 74 such that rotation of each rod in the plurality of rods 86 either moves the drive plate 74 and, in turn, the motor assembly 38, relative to the collection tank 14 or a surface disposed above the collection tank 14. For example, rotating the plurality of rods 86 in a first direction moves the motor assembly 38 away from the collection tank 14 or a surface above the collection tank 14, and rotating the plurality of rods 86 in a second direction moves the motor assembly 38 toward the collection tank 14 or the surface above the collection tank 14. In particular, the plurality of rods 86 includes three rods that are disposed circumferentially around the drive plate 74 and extend from the horizontal plate 34 toward and through the drive plate 74. In other examples, the plurality of rods 86 can include more or less than three rods. Each rod in the plurality of rods 86 is threaded and received by a threaded bore in the drive plate 74. So, rotation of each rod in the plurality of rods 86 causes the drive plate 74 to move either up or down. In other words, rotation of each rod in the plurality of rods causes the drive plate 74 to move either toward or away from the collection tank 14 or the surface above the collection tank 14. So configured, rotation of the plurality of rods 86 adjusts the position of the pulverizer 42 within the collection tank 14.

An elongated cylinder 90 is coupled to the drive plate 74 and extends from the drive plate 74 toward the pulverizer 42 for a distance. The elongated cylinder 90 surrounds the drive shaft 76 as well as other components. So configured, the elongated cylinder 90 prevents clusters of chips and individual chips from coming into contact with the drive shaft 76 and other impact components. In some examples the elongated cylinder 90 is sealed so that fluid within the collection tank 14 cannot come into contact with the components disposed within the elongated cylinder 90 (e.g., the drive shaft 76).

Figure 6:
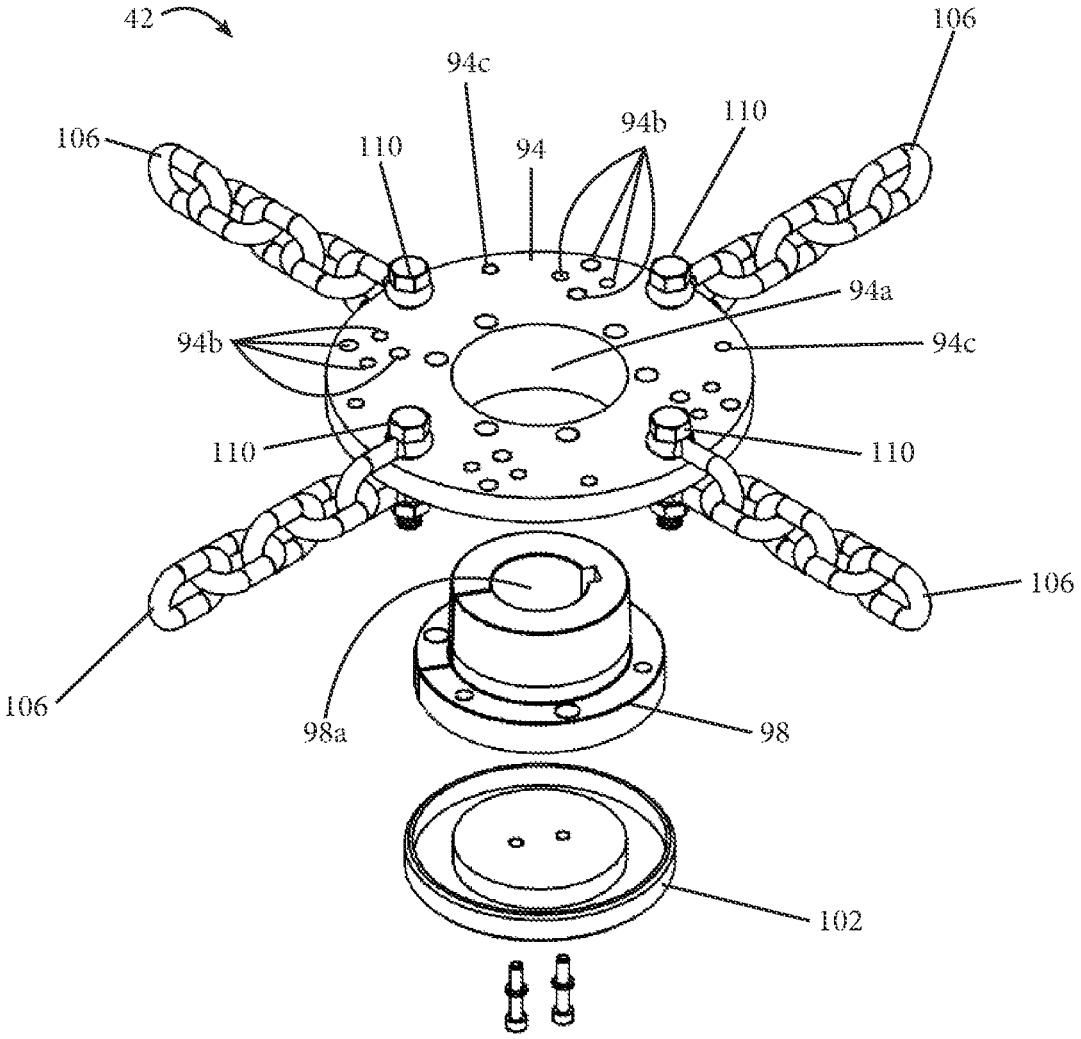
FIG. 6 is an exploded perspective view of the rotor assembly of the pneumatic chip separator of FIG. 3, constructed in accordance with the present disclosure.

As illustrated in FIG. 3, the pulverizer 42 is operably coupled to one end of the drive shaft 76. Turning to FIG. 6, the pulverizer 42 includes a base plate 94, a bushing 98 releasably coupled to the base plate 94, a cap 102 releasably coupled to the bushing 98, and a plurality of pulverizer attachments 106 coupled to the base plate 94. The base plate 94 is circular and includes a main aperture 94*a* and a plurality of secondary apertures 94*b*, 94*c*. The main aperture 94*a* is configured to receive the bushing 98 and the plurality of secondary apertures 94*b*, 94*c* is configured to secure the plurality of pulverizer attachments 106 to the base plate 94. The base plate 94 also includes other apertures that can be used, for example, to secure different types of pulverizer attachments thereto. The bushing 98, once placed in the main aperture 94*a* of the base plate 94, is releasably secured to the base plate 94 using, for example, fasteners (not shown) in a conventional manner. The bushing 98 includes a bushing aperture 98*a* that releasably receives an end of the drive shaft 76 such that rotation of the drive shaft 76 causes rotation of the bushing 98 and, in turn, the entirety of the pulverizer 42.

As discussed above, the pulverizer 42 includes the plurality of pulverizer attachments 106, which is carried by, and disposed on, the base plate 94. As illustrated in FIG. 6, the plurality of pulverizer attachments 106 includes four chains, each coupled to the base plate 94 by a fastener 110 such as, for example, a nut and bolt. In the example pulverizer 42 of FIG. 6, the four chains are spaced equidistant from one another circumferentially around the base plate 94. However, in other examples, the four chains that make up the plurality of pulverizer attachments 106 can be placed at different intervals, circumferentially around the base plate 94. Each of the four chains are equal in length, but can be varying lengths in other examples. Moreover, in other examples, there may be more or less than four chains. In the various examples, the pulverizer attachments 106 are configured to be balanced about the base plate 94.

Figure 7:
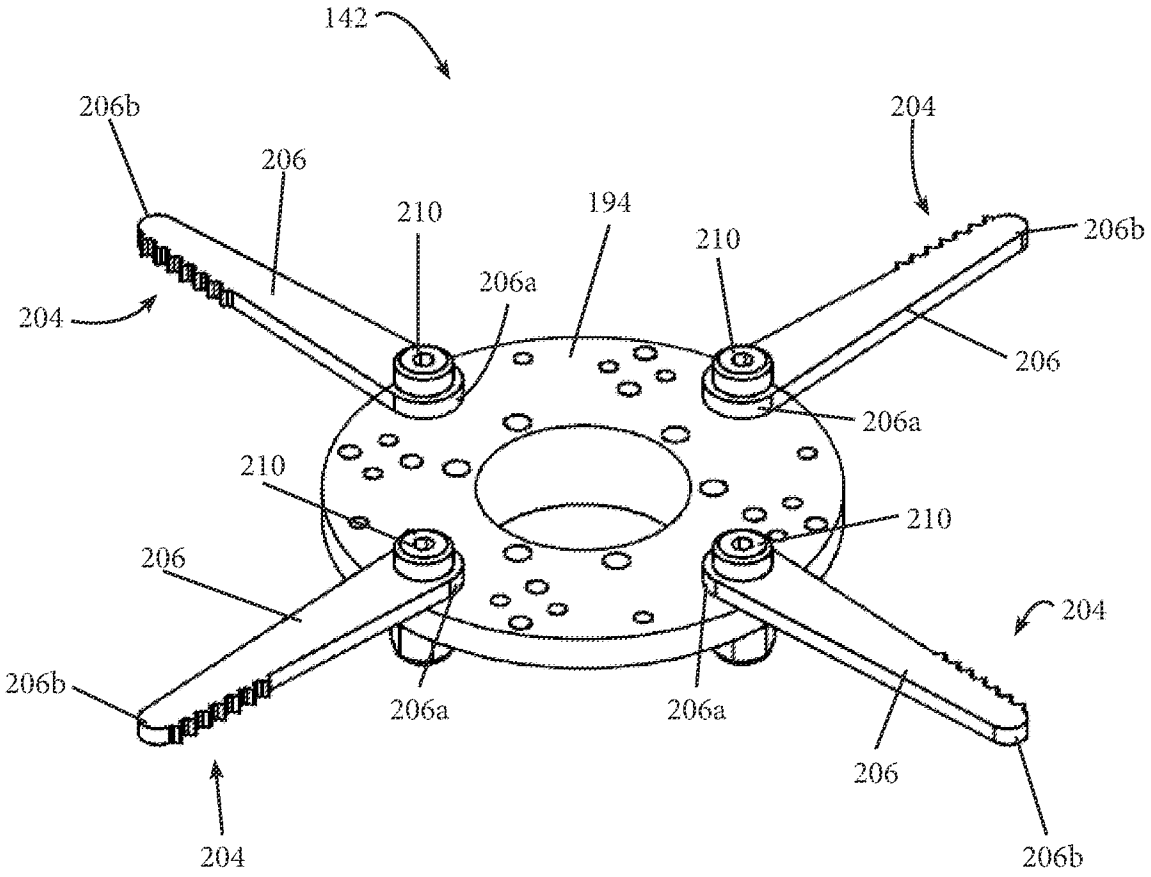
FIG. 7 is a perspective view of an example rotor assembly for use with the pneumatic chip separator of FIG. 3, constructed in accordance with the present disclosure.
Figure 8:
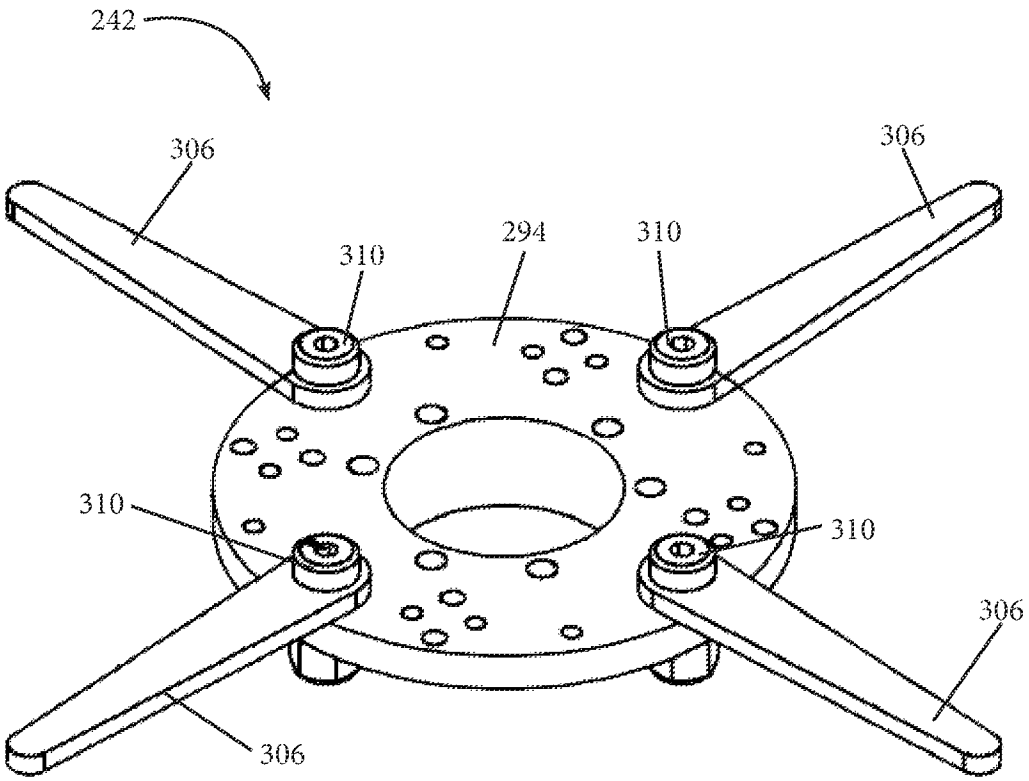
FIG. 8 is a perspective view of another example rotor assembly for use with the pneumatic chip separator of FIG. 3, constructed in accordance with the present disclosure.

FIGS. 7 and 8 illustrate two different example pulverizers 142, 242 that are similar to the pulverizer 42 of FIG. 6 in that the pulverizer 142 of FIG. 7 and the pulverizer 242 of FIG. 8 include a base plate 194, 294 and a plurality of pulverizer attachments 206, 306. However, unlike the pulverizer 42 of FIG. 6, the pulverizer 142 of FIG. 7 and the pulverizer 242 of FIG. 8 include different pluralities of pulverizer attachments 206, 306.

In particular, as illustrated in FIG. 7, each pulverizer attachment of the plurality of pulverizer attachments 206 of FIG. 7 is an articulating blade that is releasably coupled to the base plate 194 via a fastener 210. So configured, each articulating blade can pivot about the fastener 210 when the articulating blade comes into contact with a clump of chips with a predetermined amount of force. Advantageously, this allows the articulating blades to disentangle clusters of chips but also allows the articulating blades to pivot away from tough clusters of chips thereby avoiding, or minimizing, damage to the pulverizer 142.

Once an articulating blade pivots in response to coming into contact with a cluster of chips, the centrifugal force generated by the rotating base plate 194 causes the articulating blade to return to the position the articulating blade was in before pivoting out of the way of the cluster of chips. In other embodiments, the base plate 194 can include a return mechanism that allows the blade to pivot out of the way when a cluster of chips is encountered and then returns the blade to the position it was in before encountering the cluster of chips.

Each articulating blade in the plurality of pulverizer attachments 206 has an elongated body having a first end 206*a* and a second end 206*b*. An aperture that is configured to receive the fastener 210 is disposed in the first end 206*a* of the articulating blade. A portion of the articulating blade disposed proximate the second end 206*b* is serrated 204, which may allow the articulating blade to more efficiently disentangle clusters of chips.

While the plurality of pulverizer attachments 206 in FIG. 7 are illustrated as being disposed on the same surface of the base plate 194, at least one pulverizer attachment of the plurality of pulverizer attachments 206 may be disposed on a different surface from the other pulverizer attachments. For example, two pulverizer attachments of the plurality of pulverizer attachments 206 can be disposed on a first surface of the base plate 194 and two other pulverizer attachments of the plurality of pulverizer attachments 206 can be disposed on a second surface of the base plate 194 that is opposite of the first surface. Similarly, the plurality of pulverizer attachments 206 may take any shape and size, and include any number of articulating blades. For example, the plurality of pulverizer attachments 206 can include 1, 2, 3, 4, 5, 6, 7, 8, 9, 10, etc. individual articulating blades.

In some examples, each articulating blade in the plurality of pulverizer attachments 206 can include a tip made of a material that is stronger (i.e., has a greater material hardness) than the material used to make each articulating blade, which allows each articulating blade in the plurality of pulverizer attachments 206 to more accurately cut and size clusters of chips. For example, the tip of the articulating blade can be made of carbide and integrally formed with the blade 70. In other examples, a carbide insert can be releasably attached to the tip of each articulating blade in the plurality of pulverizer attachments 206. In such an example, the carbide insert extends longitudinally into the articulating blade to anchor the carbide insert and can be attached to the tip using any appropriate attachment mechanism, such as, for example, friction fit, adhesive, tongue and groove, threaded fastener, etc. The carbide insert allows for quick replacement of the carbide tip, which may lead to less down time for maintenance. Any carbide can be used, such as, for example, tungsten carbide or titanium carbide.

While the plurality of pulverizing attachments 206 have been described as being a chain, a blade, or a serrated blade, the plurality of pulverizing attachments 26, in other examples, can be heavy plastic cord, a wire, or a braided wire.

Turning now to FIG. 8, which illustrates the pulverizer 242 that includes a plurality of pulverizer attachments 306 that is releasably coupled to a base plate 294. Each pulverizer attachment of the plurality of pulverizer attachments 306 of FIG. 8 is an articulating blade that is releasably coupled to the base plate 294 via a fastener 310. So configured, each articulating blade can pivot about the fastener 310 when the articulating blade comes into contact with a clump of chips with a predetermined amount of force. Advantageously, this allows the articulating blades to disentangle clusters of chips but also allows the articulating blades to pivot away from tough clusters of chips thereby avoiding, or minimizing, damage to the pulverizer 242.

While the plurality of pulverizer attachments 306 in FIG. 8 are illustrated as being disposed on the same surface of the base plate 294, at least one pulverizer attachment of the plurality of pulverizer attachments 306 may be disposed on a different surface from the other pulverizer attachments. For example, two pulverizer attachments of the plurality of pulverizer attachments 306 can be disposed on a first surface of the base plate 294 and two other pulverizer attachments of the plurality of pulverizer attachments 306 can be disposed on a second surface of the base plate 294 that is opposite of the first surface. Similarly, the plurality of pulverizer attachments 306 may take any shape and size, and include any number of articulating blades. For example, the plurality of pulverizer attachments 306 can include 1, 2, 3, 4, 5, 6, 7, 8, 9, 10, etc. individual articulating blades.

In some examples, each articulating blade in the plurality of pulverizer attachments 306 can include a tip made of a material that is stronger (i.e., has a greater material hardness) than the material used to make each articulating blade, which allows each articulating blade in the plurality of pulverizer attachments 306 to more accurately cut and size clusters chips. For example, the tip of the articulating blade can be made of carbide and integrally formed with the articulating blade. In other examples, a carbide insert can be releasably attached to the tip of each articulating blade in the plurality of pulverizer attachments 206. In such an example, the carbide insert extends longitudinally into the articulating blade to anchor the carbide insert and can be attached to the tip using any appropriate attachment mechanism, such as, for example, friction fit, adhesive, tongue and groove, threaded fastener, etc. The carbide insert allows for quick replacement of the carbide tip, which may lead to less down time for maintenance. Any carbide can be used, such as, for example, tungsten carbide or titanium carbide.

Additionally, the chip separator 30 may include at least one sensor 114, 118 for measuring or detecting various parameters during use of the chip separator 30. In particular, a first sensor 114 may be disposed proximate the chip separator 30 such that the first sensor 114 measures the fluid flow rate through the plurality of pumps 22. For example, the first sensor 114 can be placed through the pipe 26*a*, 26*b* such that an end of the first sensor 114 is disposed within the pipe 26*a*, 26*b*. The first sensor 114 may be any sensor capable of detecting fluid flow. If the first sensor 114 measures a fluid flow rate that is below or greater than a predetermined fluid flow rate, the first sensor 114 can transmit a fault signal to the control module. In some examples, the fault signal can be displayed on the user interface of the control module and/or transmitted to the machining center or mill. The control module can, in some examples, transmit a stop signal to turn off the plurality of pumps 22 until the issue causing the fault signal is resolved. The plurality of pumps 22 can be turned on automatically by the control module, in some examples, or can be manually turned on, in other examples, when the issue causing the fault signal is resolved. Additionally, in some examples, the first sensor 114 can transmit the measured fluid flow rate to the control module, which, in turn, can display the measured fluid flow rate on the user interface.

A second sensor 118 may be disposed proximate the pulverizer 42 such that the second sensor 118 detects when the pulverizer 42, and in particular the plurality of pulverizer attachments 106, is jammed. For example, the second sensor 118 can be disposed on or through the elongated cylinder 90 and proximate the plurality of pulverizer attachments 106, 206, 306. The second sensor 118 may be any type of sensor capable of detecting a distance between certain objects and the second sensor. For example, the second sensor 118 can be a proximity switch and, in particular, a proximity switch capable of storing an interval at which at least one object passes the second sensor 118 during normal operation and comparing a measured interval at which the at least one object passes the second sensor 118 to the stored interval. For the purposes of the discussion of the second sensor 118, "normal operation" means unimpeded rotation of the pulverizer 42. For example, each pulverizer attachment in the plurality of pulverizer attachments 106, 206, 306 passes the second sensor 118 at an interval during normal operation. That interval is stored in a memory of the second sensor 118 to be later used as a baseline when comparing and determining if a measured interval is substantially equal to the previously stored interval. If the measured interval is greater than or less than the stored interval, then the second sensor 118 can transmit a remedial signal to the control module causing the control module to execute logic that corrects the disparity between the measured interval and the stored interval. For example, the control module can execute a jam clearing logic that, when executed, causes the plurality of pulverizer attachments 106, 206, 306 to rotate in a direction opposite the operational direction of rotation to clear any chips that may have caused the plurality of pulverizer attachments 106, 206, 306 to jam. In other examples, the control module can execute a power down logic that, when executed, causes the plurality of pulverizer attachments 106, 206, 306 to stop rotating. The power down logic can be executed when the second sensor 118 detects that the measured interval is greater than or less than the stored interval. In other examples, the control module can execute the power down logic when execution of the jam clearing logic fails to return the plurality of pulverizer attachments 106, 206, 306 to normal operation.

Those skilled in the art will recognize that a wide variety of modifications, alterations, and combinations can be made with respect to the above described examples without departing from the scope of the disclosure, and that such modifications, alterations, and combinations are to be viewed as being within the ambit of the inventive concept.

I claim:

1. A system for disentangling clusters of chips in a mixture of chips and fluid, the system comprising:

a collection tank comprising:

a body;

a cover coupled to the body; and an intake disposed on and extending through the body, the intake configured to be fluidly coupled to a trough such that the mixture of chips and fluid enters the body through the intake; and a chip separator configured to be disposed at least partially within the body of the collection tank such that the chip separator is disposed proximate the intake, the chip separator comprising:

a horizontal plate having a first surface and a second surface opposite the first surface;

a motor assembly operably coupled to the first surface of the horizontal plate;

a plurality of rods that operably couple the horizontal plate and the motor assembly, wherein when each rod of the plurality of rods rotates in a first direction, the motor assembly moves away from the collection tank, and when each rod of the plurality of rods rotates in a second direction opposite the first direction, the motor assembly moves toward the collection tank; and a pulverizer operably coupled to the motor assembly and disposed away from the second surface of the horizontal plate by a distance, the pulverizer comprising:

a base plate; and a plurality of pulverizer attachments operably coupled to the base plate, and wherein, the motor assembly is configured to rotate the pulverizer such that the plurality of pulverizer attachments of the pulverizer separate the clusters of chips disposed in the collection tank.

2. The system of claim 1, further comprising a plurality of securement mechanisms coupled to the horizontal plate, the plurality of securement mechanisms configured to secure the horizontal plate to the cover of the collection tank or a surface above the collection tank.

3. The system of claim 1, wherein the motor assembly includes a drive, a drive shaft that operably couples the drive and the pulverizer, and a drive plate that releasably receives the drive.

4. The system of claim 1, further comprising an elongated cylinder extending from the motor assembly towards the pulverizer for a distance.

5. The system of claim 3, further comprising an elongated cylinder coupled to the drive plate of the motor assembly, the elongated cylinder extending from the drive plate toward the pulverizer for a distance.

6. The system of claim 1, wherein the plurality of pulverizer attachments comprises a plurality of chains releasably coupled to the base plate.

7. The system of claim 1, wherein the plurality of pulverizer attachments comprises a plurality of blades releasably coupled to the base plate.

8. The system of claim 7, wherein at least a portion of at least one blade of the plurality of blades is serrated.

* * * * *